US011001997B2

(12) United States Patent
Ettiene

(10) Patent No.: US 11,001,997 B2
(45) Date of Patent: May 11, 2021

(54) GRADUATED OVAL PLUNGER SYSTEM

(71) Applicant: David Ettiene, Crescent, PA (US)

(72) Inventor: David Ettiene, Crescent, PA (US)

( * ) Notice: Subject to any disclaimer, the term of this patent is extended or adjusted under 35 U.S.C. 154(b) by 0 days.

(21) Appl. No.: 16/718,283

(22) Filed: Dec. 18, 2019

(65) Prior Publication Data

US 2020/0199859 A1 Jun. 25, 2020

Related U.S. Application Data

(60) Provisional application No. 62/783,402, filed on Dec. 21, 2018.

(51) Int. Cl.
*E03C 1/308* (2006.01)

(52) U.S. Cl.
CPC ..... *E03C 1/308* (2013.01)

(58) Field of Classification Search
CPC . E03C 1/308; E03C 1/304; E03C 1/30; E03D 11/00
USPC ..... 4/255.11, 255.05
See application file for complete search history.

(56) References Cited

U.S. PATENT DOCUMENTS 657,858 A * 9/1900 Cornelius ..... E03C 1/308 4/255.12
1,304,196 A * 5/1919 Noppel ..... E03C 1/308 4/255.02
1,972,114 A * 9/1934 Stephenson ..... E03C 1/308 4/255.12
2,126,689 A * 8/1938 Pouliot ..... E03C 1/308 4/255.11
2,195,830 A * 4/1940 Schubring ..... E03C 1/308 4/255.11
2,607,927 A * 8/1952 Scott ..... E03C 1/308 4/255.11
2,844,826 A * 7/1958 Cheiten ..... E03C 1/308 4/255.11
2,997,300 A * 8/1961 House ..... A63B 25/08 482/18
3,315,280 A * 4/1967 Krenn ..... E03C 1/302 4/255.01
4,745,641 A * 5/1988 Tash ..... E03C 1/308 4/255.11
6,192,525 B1 * 2/2001 Tash ..... E03C 1/308 4/255.11

(Continued)

*Primary Examiner* — Benjamin R Shaw
(74) *Attorney, Agent, or Firm* — Lyman Moulton, Esq.; Moulton Patents, PLLC

(57) ABSTRACT

A disclosed plunging apparatus, system and method includes applying a graduated accordian suction apparatus defining an oval opening and gradually larger plunging sections, wherein a cross section of each gradually larger plunging section resembles a tear drop perimeter having a globular form at a bottom tapering to an apogee point top. The method also includes securing a projecting lip around the oval opening adjacent a toilet bowl drain. The method additionally includes commencing a plunging action via a smallest plunging section proximal the oval opening. The method further includes enabling the plunging action via a collapsible webbing there between the graduated plunging sections. The method yet includes continuing the plunging action via a largest plunging section distal the oval opening. The method even includes repeating the plunging action via a handle attached to one of the graduated plunging sections.

20 Claims, 7 Drawing Sheets

(56) References Cited

U.S. PATENT DOCUMENTS

| | | | | |
|---|---|---|---|---|
| 6,216,283 | B1 * | 4/2001 | Tash | A61K 31/51 4/255.01 |
| 6,374,427 | B1 * | 4/2002 | Tash | E03C 1/308 4/255.11 |
| 7,089,605 | B2 * | 8/2006 | Jiang | E03C 1/308 16/429 |
| 2001/0037522 | A1 * | 11/2001 | Pool | E03C 1/308 4/255.11 |
| 2003/0079278 | A1 * | 5/2003 | Tash | E03C 1/30 4/255.11 |
| 2004/0025235 | A1 * | 2/2004 | Tash | E03D 9/00 4/255.01 |
| 2004/0064878 | A1 * | 4/2004 | Walsh | E03D 9/00 4/255.11 |
| 2008/0134421 | A1 * | 6/2008 | Sheffield | E03C 1/308 4/255.11 |
| 2014/0033419 | A1 * | 2/2014 | Daciw | E03C 1/308 4/255.11 |
| 2015/0218787 | A1 * | 8/2015 | Wong | E03C 1/308 4/255.11 |
| 2016/0215487 | A1 * | 7/2016 | Ginther | E03C 1/308 |
| 2016/0298322 | A1 * | 10/2016 | Zavala | E03C 1/308 |
| 2019/0277013 | A1 * | 9/2019 | Cavalcanti | E03C 1/308 |
| 2019/0329302 | A1 * | 10/2019 | Wu | E03C 1/304 |
| 2021/0017747 | A1 * | 1/2021 | Morse | E03C 1/308 |

* cited by examiner

GRADUATED OVAL PLUNGER SYSTEM

CROSS REFERENCE TO RELATED APPLICATIONS

The present non-provisional patent application claims priority to the Provisional application 62/783,402 filed Dec. 21, 2018 by David Ettiene for a "Plunger System," which is included in its entirely in the present application.

BACKGROUND OF THE INVENTION

Field of Invention

The present invention relates to an oval shape plunger adapted for placement over an oval drain.

Description of Related Art

Plungers are a common plumber tool used to release and unstop drain pipes. Many times drain pipes clog and require placement of a plunger over the opening to release the clogged drain. The plunger functions by applying pressure from a first position and then releases to a second position and therefore causing the release of the clog within the drain. Plungers are a very effective tool that has been used for many years for this purpose.

Many recent drain openings have been developed with a oval-type shape as opposed to traditional round shape. These oval shaped openings makes it difficult for the traditional plunger to fit over the drains and to have an effective seal on the drain. Having an effective seal over the drain is important to have the pressure exchange that is created with the plunger.

It is therefore an object of the present invention to provide an oval shape accordion type plunger that has a graduated perimeter to size to accommodate the modern oval drain opening.

SUMMARY

The disclosed method includes applying 110 a graduated accordian suction apparatus defining an oval opening and gradually larger plunging sections, wherein a cross section of each gradually larger plunging section resembles a tear drop perimeter having a globular form at a bottom tapering to an apogee point top. The method also includes securing 120 a projecting lip around the oval opening adjacent a toilet bowl drain. The method additionally includes commencing 130 a plunging action via a smallest plunging section proximal the oval opening. The method further includes enabling 140 the plunging action via a collapsible webbing there between the graduated plunging sections. The method yet includes continuing 150 the plunging action via a largest plunging section distal the oval opening. The method even includes repeating 160 the plunging action via a handle attached to one of the graduated plunging sections.

Figure 1:
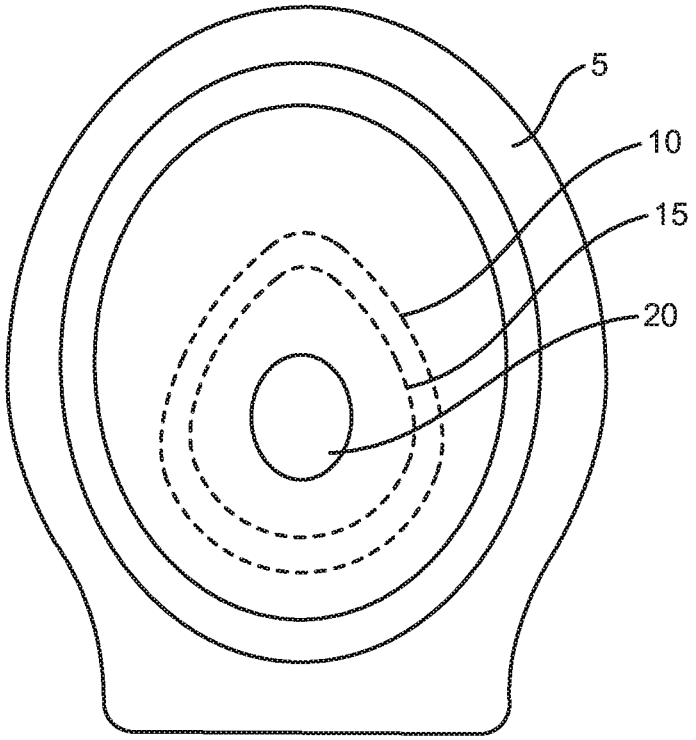
(Prior Art) FIG. 1
FIG. 1 depicts a top elevational view of a conventional toilet bowl.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Through the present description, the term 'oval,' references a geometry of an opening which includes rounded and square corner ovals according to various conventional toilet bowl designs.

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

The present invention relates to the plunger assembly includes a traditional handle with a suction apparatus at the distal end thereof. The suction apparatus according to the present invention includes an accordion shape with an oval lip opening and a tear drop perimeter sections separated by webbing. The graduated accordian section size graduates from the bottom to the top edge of the plunger. The bottom has the smallest perimeter and gradually decreases to the top of the plunger which is attached to the handle in some embodiments. An oval opening is provided at the contact edge of the plunger that is directed over a drain opening.

FIG. 1 depicts a top elevational view of a conventional toilet bowl. The toilet bowl rim 5 defines a top edge of the toilet bowl. Between the rim 5 and the toilet bowl drain 20 lie 2 graduated water marks shown in broken lines 10 and 15 which outline a tear drop shaped perimeter. This tear drop perimeter is used to set the perimeter of graduated tear drop shaped plunging sections.

Figure 2:
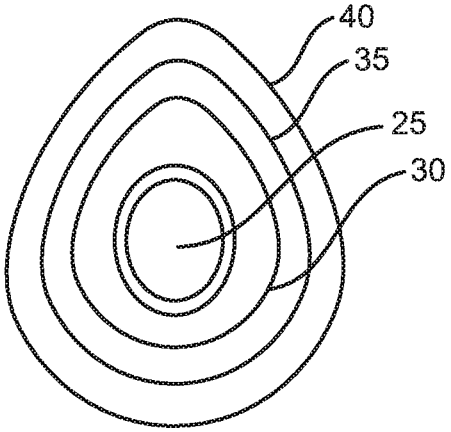
FIG. 2 depicts a bottom elevational view of the disclosed graduated oval plunger in accordance with an embodiment of the present disclosure.

FIG. 2 depicts a bottom elevational view of the disclosed graduated oval plunger in accordance with an embodiment of the present disclosure. The tear drop water marks 10 and 15 of the conventional toilet bowl are used to set the perimeter of the graduated tear drop shaped plunging sections 30, 35 and 40. The toilet bowl drain 20 is used to set the lip 25 geometry of the plunger.

Figure 3:
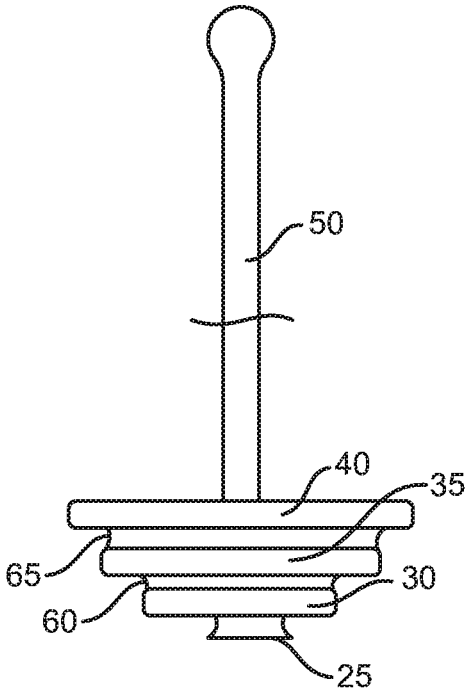
FIG. 3 depicts a side elevational view of the disclosed graduated oval plunger in accordance with an embodiment of the present disclosure.

FIG. 3 depicts a side elevational view of the disclosed graduated oval plunger in accordance with an embodiment of the present disclosure. The depiction includes the oval shaped lip 25, the first and smallest tear drop perimeter section 30, the second tear drop section 35 and the 3$^{rd}$ and largest tear drop perimeter section 40. The collapsible webbing 60 and 65 connect or separate the respective sections. The handle 50 is attached to the third section in the present embodiment.

Figure 4:
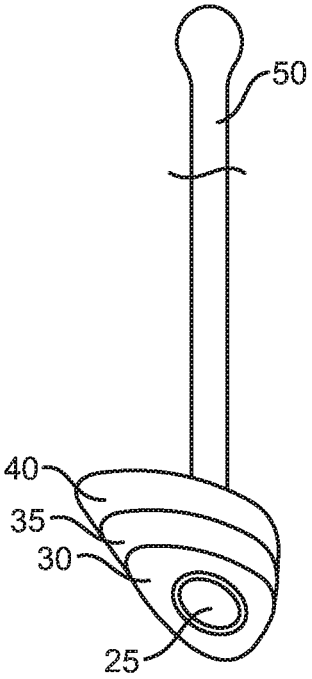
FIG. 4 depicts a side bottom perspective view of the disclosed plunger assembly in accordance with an embodiment of the present disclosure.

FIG. 4 depicts a side bottom perspective view of the disclosed plunger assembly in accordance with an embodiment of the present disclosure. The depiction includes the oval shaped lip 25, the first and smallest tear drop perimeter section 30, the second tear drop section 35 and the 3$^{rd}$ and largest tear drop perimeter section 40. The handle 50 is attached to the third section in the present embodiment. The webbing is present though not visible in this perspective drawing.

Figure 5:
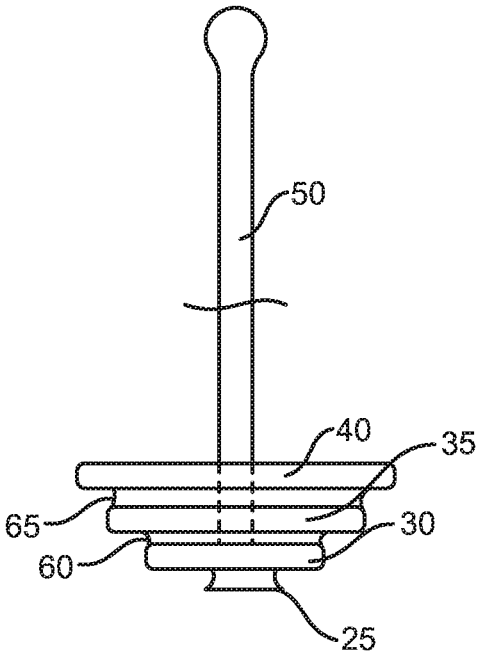
FIG. 5 depicts a side elevational view of the disclosed graduated oval plunger handle attached most proximal the lip in accordance with an embodiment of the present disclosure.

FIG. 5 depicts a side elevational view of the disclosed graduated oval plunger handle attached most proximal the lip in accordance with an embodiment of the present disclosure. The depiction includes the oval shaped lip 25, the first and smallest tear drop perimeter section 30, the second tear drop section 35 and the 3$^{rd}$ and largest tear drop perimeter section 40. The collapsible webbing 60 and 65 connect or separate the respective sections. The handle 50 is attached to the first section in the present embodiment and therefore passes through the other sections shown in broken lines. The other sections are designed to seal in an o-ring type design in order that the handle may pass there through and maintain a suction for plunging.

Figure 6:
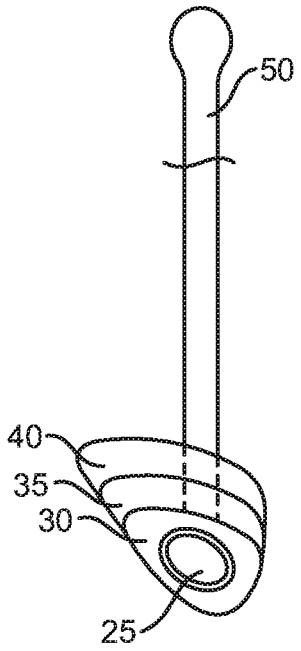
FIG. 6 depicts a side bottom perspective view of the disclosed plunger assembly handle attached most proximal the lip in accordance with an embodiment of the present disclosure.

FIG. 6 depicts a side bottom perspective view of the disclosed plunger assembly handle attached most proximal the lip in accordance with an embodiment of the present disclosure. The depiction includes the oval shaped lip 25, the first and smallest tear drop perimeter section 30, the second tear drop section 35 and the 3$^{rd}$ and largest tear drop perimeter section 40. The handle 50 is attached to the third section in the present embodiment. The webbing is present though not visible in this perspective drawing. The other sections are designed to seal in an o-ring type design in order that the handle may pass there through and maintain a suction for plunging.

Figure 7:
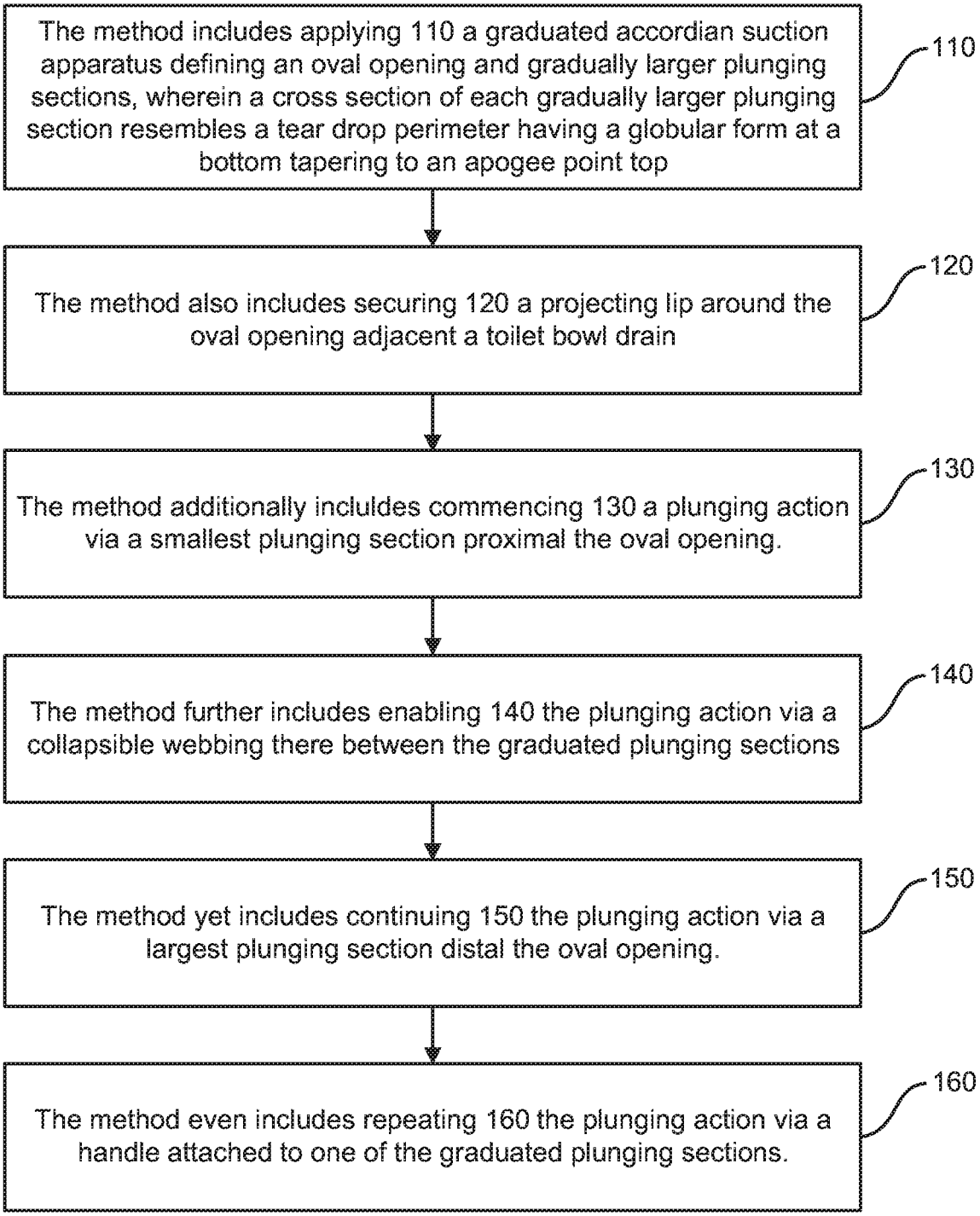
FIG. 7 depicts a flow diagram of a method of using the disclosed plunger assembly in accordance with an embodiment of the present disclosure.

FIG. 7 depicts a flow diagram of a method of using the disclosed plunger assembly in accordance with an embodiment of the present disclosure. The method includes applying 110 a graduated accordian suction apparatus defining an oval opening and gradually larger plunging sections, wherein a cross section of each gradually larger plunging section resembles a tear drop perimeter having a globular form at a bottom tapering to an apogee point top. The method also includes securing 120 a projecting lip around the oval opening adjacent a toilet bowl drain. The method additionally includes commencing 130 a plunging action via a smallest plunging section proximal the oval opening. The method further includes enabling 140 the plunging action via a collapsible webbing there between the graduated plunging sections. The method yet includes continuing 150 the plunging action via a largest plunging section distal the oval opening. The method even includes repeating 160 the plunging action via a handle attached to one of the graduated plunging sections.

Specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. A plunger apparatus comprising:

a graduated accordian plunging apparatus defining an oval opening and gradually larger plunging sections comprising;

a projecting lip around the oval opening;

a smallest tear drop perimeter section proximal the oval opening;

a largest tear drop perimeter section distal the oval opening; and a graduated plurality of tear drop perimeter sections therebetween, wherein a cross section of each gradually larger plunging section resembles a tear drop perimeter having a globular form at a bottom tapering to an apogee point top.

2. The plunger apparatus of claim 1, further comprising a collapsible webbing between each of the tear drop perimeters.

3. The plunger apparatus of claim 1, further comprising a handle mechanism attached to the largest tear drop perimeter.

4. The plunger apparatus of claim 1, wherein the number of graduated plurality of tear drop perimeters is one to three.

5. The plunger apparatus of claim 1, wherein the oval opening defined by the accordian suction apparatus is shaped similar to an oval drain opening in a conventional toilet bowl.

6. The plunger apparatus of claim 1, wherein the graduated tear drop perimeters are shaped similar to graduated water marks in a conventional toilet bowl.

7. The plunger apparatus of claim 1, wherein the smallest tear drop perimeter collapses into the graduated plurality of tear drop perimeters.

8. The plunger apparatus of claim 1, wherein the graduated plurality of tear drop perimeters collapse into the largest tear drop perimeter.

9. The plunger apparatus of claim 1, wherein a webbing between tear drop perimeters is a lower durometer proximal the apogee and a higher durometer distal the apogee to enable an angular plunging application.

10. The plunger apparatus of claim 1, wherein a webbing between tear drop perimeters is thinner proximal the apogee and thicker distal the apogee to enable an angular plunging application.

11. A plunger system comprising:

a graduated accordian suction apparatus defining an oval opening and gradually larger plunging sections, wherein a cross section of each gradually larger plunging section resembles a tear drop perimeter having a globular form at a bottom tapering to an apogee point top;

a projecting lip around the oval opening;

a smallest plunging section proximal the oval opening;

a largest plunging section distal the oval opening; and a collapsible webbing there between the graduated plunging sections; and a handle attached to one of the graduated plunging sections.

12. The plunger system of claim 11, wherein the graduated plunging sections collapse into one another in an accordian plunging action.

13. The plunger system of claim 11 wherein the webbing between the graduated plunging sections is configured to collapse more easily proximal the apogee and collapse less easily distal the apogee in relation to a plunging effort by a user of the plunging system.

14. The plunging system of claim 11, wherein the handle is attached to the smallest plunging section and passes through the other graduated plunging sections to enable a sucking action to commence at the smallest plunging section proximal the projecting lip and to continue gradually to the largest plunging section most distal the projecting lip.

15. The plunging system of claim 11, wherein the handle is attached to the largest plunging section to enable a sucking action to commence at the largest plunging section most distal the projecting lip and to continue gradually to the smallest plunging section most proximal the projecting lip.

16. A plunging method comprising:

applying a graduated accordian suction apparatus defining an oval opening and gradually larger plunging sections, wherein a cross section of each gradually larger plunging section resembles a tear drop perimeter having a globular form at a bottom tapering to an apogee point top;

securing a projecting lip around the oval opening adjacent a toilet bowl drain;

commencing a plunging action via a smallest plunging section proximal the oval opening;

enabling the plunging action via a collapsible webbing there between the graduated plunging sections;

continuing the plunging action via a largest plunging section distal the oval opening; and repeating the plunging action via a handle attached to one of the graduated plunging sections.

17. The method of claim 16, further comprising collapsing the graduated plunging sections into one another in an accordian plunging action.

18. The method of claim 16, further comprising collapsing the webbing between the graduated plunging sections proximal the apogee more than the webbing distal the apogee in relation to a plunging effort by a user of the plunging system.

19. The method of claim 16, further comprising attaching the handle to the smallest plunging section and passing it through the other graduated plunging sections to enable the sucking action to commence at the smallest plunging section proximal the projecting lip and to continue gradually to the largest plunging section most distal the projecting lip.

20. The method of claim 16, further comprising attaching the handle to the largest plunging section to enable a sucking action to commence at the largest plunging section most distal the projecting lip and to continue gradually to the smallest plunging section most proximal the projecting lip.

* * * * *